US007578508B2

(12) United States Patent
Caspi et al.

(10) Patent No.: US 7,578,508 B2
(45) Date of Patent: Aug. 25, 2009

(54) SKINNABLE ROTATING DART BOARD GAME

(75) Inventors: Yuval Caspi, Granada Hills, CA (US); Greg Dominguez, Northridge, CA (US)

(73) Assignee: MGA Entertainment, Inc., Van Nuys, CA (US)

( * ) Notice: Subject to any disclaimer, the term of this patent is extended or adjusted under 35 U.S.C. 154(b) by 0 days.

(21) Appl. No.: 11/776,690

(22) Filed: Jul. 12, 2007

(65) Prior Publication Data

US 2008/0012232 A1 Jan. 17, 2008

Related U.S. Application Data

(60) Provisional application No. 60/807,335, filed on Jul. 13, 2006.

(51) Int. Cl.
*F41J 5/04* (2006.01)

(52) U.S. Cl. ..... 273/359; 273/371; 273/374

(58) Field of Classification Search ..... 273/348.3, 273/403, 404, 407, 408, 383, 386–392
See application file for complete search history.

(56) References Cited

U.S. PATENT DOCUMENTS 1,076,002 A * 10/1913 Clarke ..... 273/368
2,077,001 A * 4/1937 Moss et al. ..... 273/368
3,784,201 A * 1/1974 Wyman et al. ..... 273/348.4
3,836,148 A * 9/1974 Manning ..... 273/368
3,850,432 A * 11/1974 Crocker ..... 273/368
4,415,162 A * 11/1983 Sheppard ..... 273/371
5,496,039 A * 3/1996 Zammuto ..... 273/368
5,603,503 A * 2/1997 Lapidus ..... 273/348.2
5,613,684 A * 3/1997 Gittens et al. ..... 273/348.3
5,954,339 A * 9/1999 Yiu ..... 273/408
6,053,499 A * 4/2000 Yiu ..... 273/374
6,062,997 A * 5/2000 Seymour ..... 473/578
6,726,209 B2 * 4/2004 Kim ..... 273/408
2002/0084589 A1 * 7/2002 Shieh ..... 273/407
2006/0192091 A1 * 8/2006 Martin et al. ..... 250/221

* cited by examiner

*Primary Examiner*—Mark S Graham
(74) *Attorney, Agent, or Firm*—Intellectual Property Law Offices of Joel Voelzke, APC

(57) ABSTRACT

A dart board game with a rotatable target for magnetic darts may include an target skin easily replaceable or reversible by a game player. Controls for an electric motor for rotating the target may be operable during game play by the magnetic darts when properly thrown may be include buttons for changing speed or direction or doing so randomly. A button may cause the changes to apply for a subsequent player.

11 Claims, 4 Drawing Sheets

SKINNABLE ROTATING DART BOARD GAME

CROSS REFERENCE TO RELATED APPLICATIONS

This application claims the benefit of provisional application Ser. No. 60/807,335 filed Jul. 13, 2006.

BACKGROUND OF THE INVENTION

1. Field of the Invention

This invention is related to dart board games and in particular to electric dart boards.

2. Description of the Prior Art

Traditional dart board games are well known and include various type of darts, targets and automatic scoring systems. So-called electric dart boards may provide automatic scoring when a dart strikes the target on the board. Other dart boards include magnetic, hook and loop and/or other techniques for replacing the conventional needle pointed dart. Dart boards are provided with target areas which may be specialized, for example, to satisfy particular rules of play.

What is needed are improvements in the dart board game play and equipment.

SUMMARY OF THE INVENTION

In a first aspect, a dart board game may include a rotatable target having a pattern thereon forming a game play target for magnetic darts, the target interacting with magnetic darts to hold the magnetic darts to the target when properly thrown and an electric motor for rotating the target during game play. The pattern may include an target skin easily replaceable by a game player. The target skin may be a two sided target skin having a different game pattern on either side, the target skin mountable on the rotatable target with either of the different game play patterns visible during game play. One or more controls for the electric motor operable during game play by the magnetic darts when properly thrown may be provided.

In another aspect, a dart board game may include a target skin having a pattern thereon forming a game play target for magnetic darts, a rotatable target support for supporting the target skin for rotation during game play, the support interacting with the magnetic darts to hold the magnetic darts to the target skin when properly thrown, and an electric motor for rotating the target skin and rotatable target support during game play. Player operated controls for changing rotational speed and direction of the target support may be provided. The player operated controls may include buttons operated in response to magnetic darts when properly thrown, such as a button for causing the rotational speed and direction of the target support to change randomly and/or a button for causing changes in the rotational speed and direction of the target support to change for a subsequent game player.

The buttons may be mounted along a periphery of the target skin or in a portable remote control housing the player operated controls. The target skin may be easily replaced or reversed by a game player to display a different game play target.

A method of playing a dart game may include applying a target skin to a rotatable target support having sufficient interaction with thrown magnetic darts to support such darts magnetically when properly thrown and rotating the target support during game play. Buttons may be provided adjacent the target skin which change the speed and direction of rotation of the rotatable target support when struck by a dart.

DETAILED DISCLOSURE OF THE PREFERRED EMBODIMENT(S)

Figure 1:
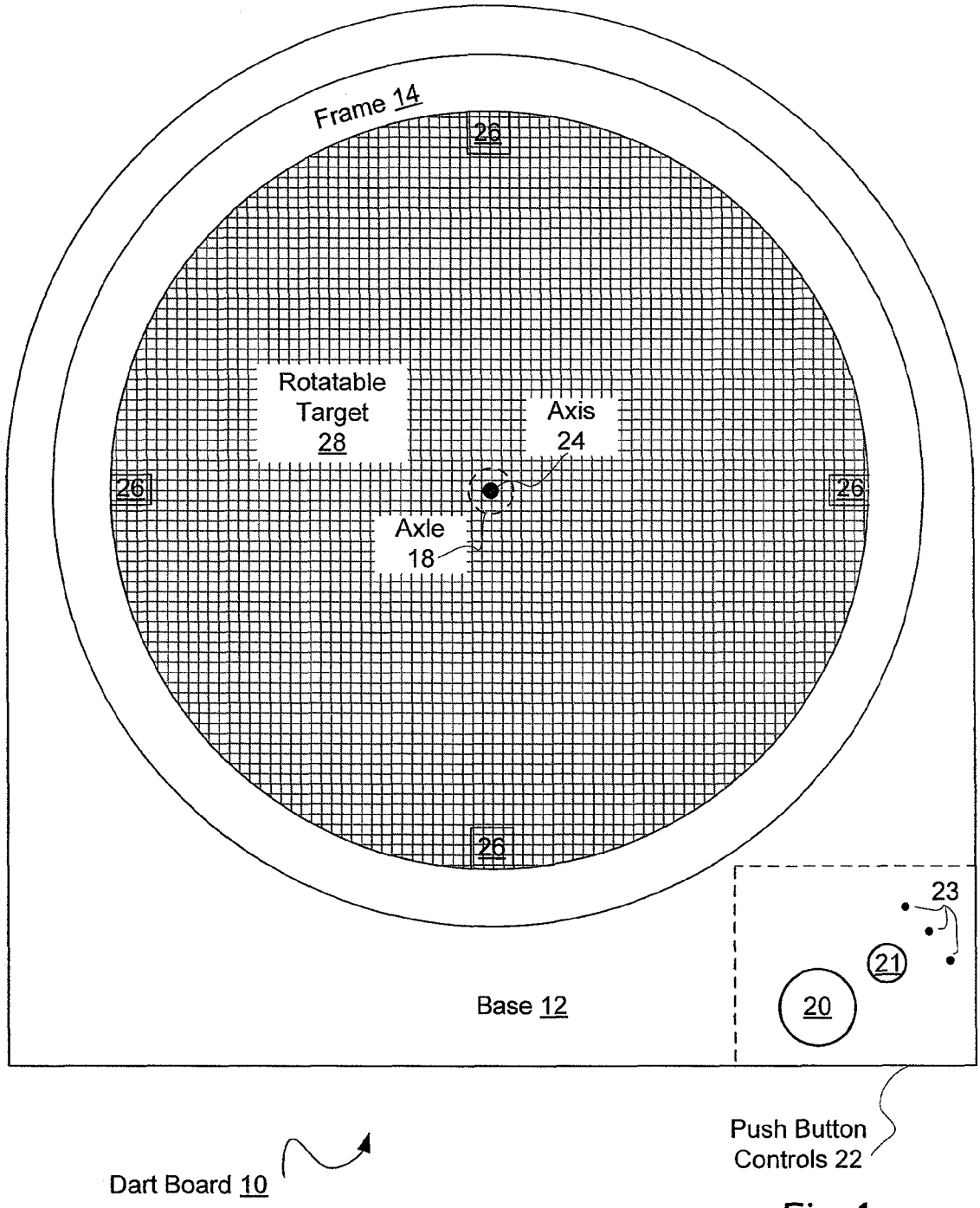
FIG. 1 is a front view of motorized dart board base 12.

Referring now to FIG. 1, dart board assembly 10 includes base 12 on which is mounted rotatable frame 14, mounted for rotation in a plane parallel to base 12 about central axis 24. Axle 18 may be mounted for rotation of frame 14, and rotatable target 28 captured therein, about axis 24. An electric motor 16, discussed below in greater detail with regard to FIG. 6, may drive axle 18 or frame 14 directly or via gears, belts, pulleys or other mechanical or friction drive techniques. Alternately, the outer circumference of frame 14 may be driven by motor 16 via gears, belts, pulleys or other mechanical or friction drive techniques. Push button controls and electronic circuitry 22 may be operated by a dart board game player or dart thrower to control operation of motor 16 and therefore rotation of frame 14 relative to base 12.

Frame 14 may also include a set of lips 26 arranged about the periphery of frame 14 to removably hold rotatable target or skin 28 for rotation. Controls 22 may then be used to cause rotation of target skin 28 about target axis 24 during game play. For example, pushbutton 20 may actuate rotation of frame 14 and target 28 around axis 24, while rotation characteristic button 21 may be used to alter the direction and/or speed of such rotation. Indicator's 23, such as LEDs, may indicate the current selection of rotation characteristic button 21, such as clockwise, counterclockwise, randomly changing rotation direction and/or speed of rotation.

Figure 2:
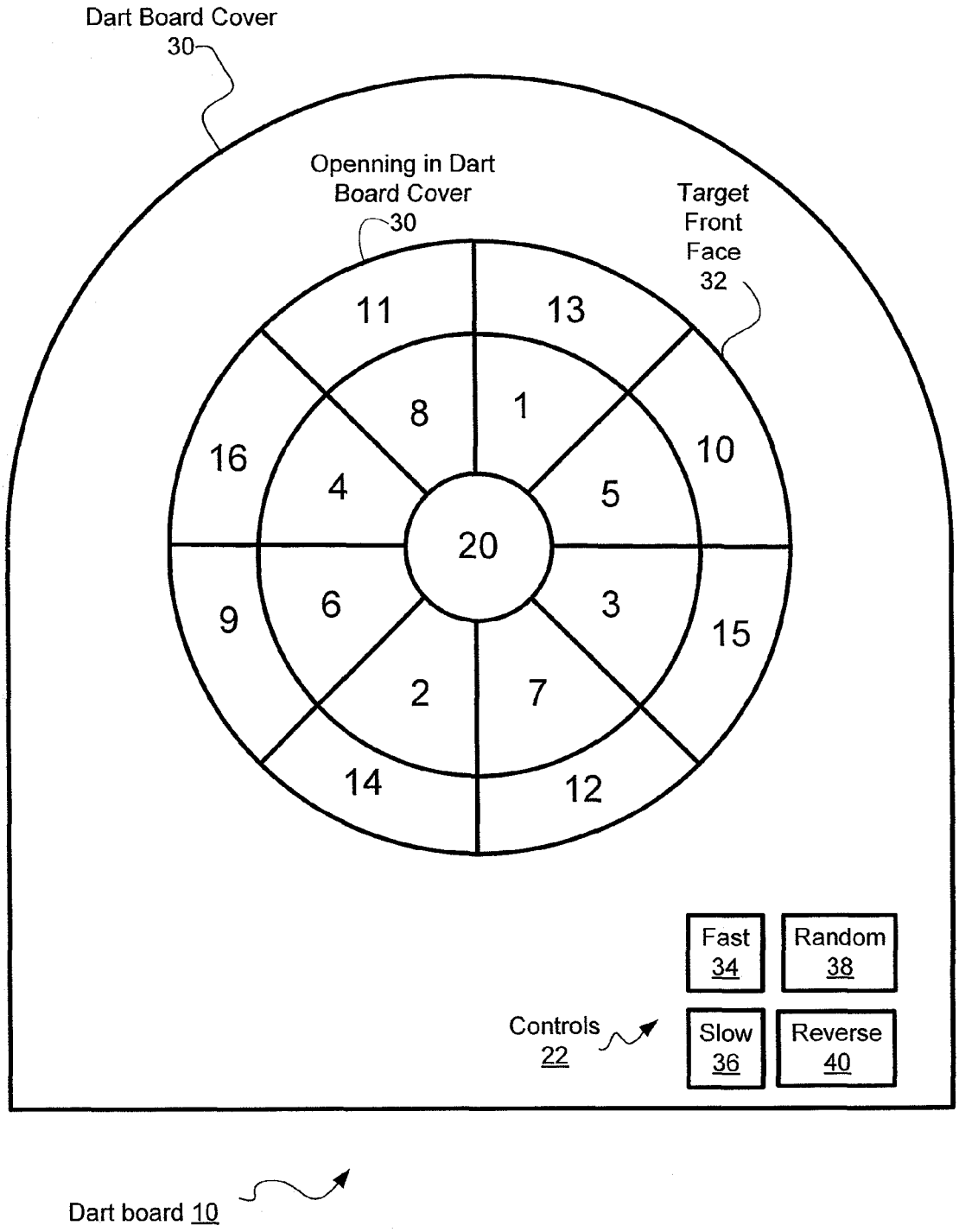
FIG. 2 is a front view of motorized dart board 10 of FIG. 1 with cover 30, showing a simple target dart board target.

Referring now also to FIG. 2, in an alternate embodiment, front face 32 of rotatable target skin 28 is shown in a circular opening of dart board cover 30 with a particular target arrangement. Controls 22 are shown to include fast button 34, slow button 36, random button 38 and reverse direction button 40 which are accessible by a dart board player. Operation of fast button 34 may control the operation of motor 12 (shown in FIG. 6) to rotate frame 14 and therefore rotate target front face 32 of rotatable target skin 28 at a relatively fast speed, preferably in the range of about 6 to about 10 rpm and most preferably about 8 rpm. Operation of slow button 36 may cause target front face 32 to rotate at a relatively slower speed, preferably in the range of about 2 to about 6 rpm and most preferably about 4 rpm. Operation of reverse button 40 may cause target 32 to rotate in the opposite direction from which it was previously rotating, that is, changing rotation from clockwise to counter clockwise or vice versa.

Operation of random button 38 may cause target face 32 to rotate at a first speed in a first direction and then after a first duration, rotate at the same or a second speed in a second direction, changing speed and/or direction at random or preprogrammed intervals.

Figure 3:
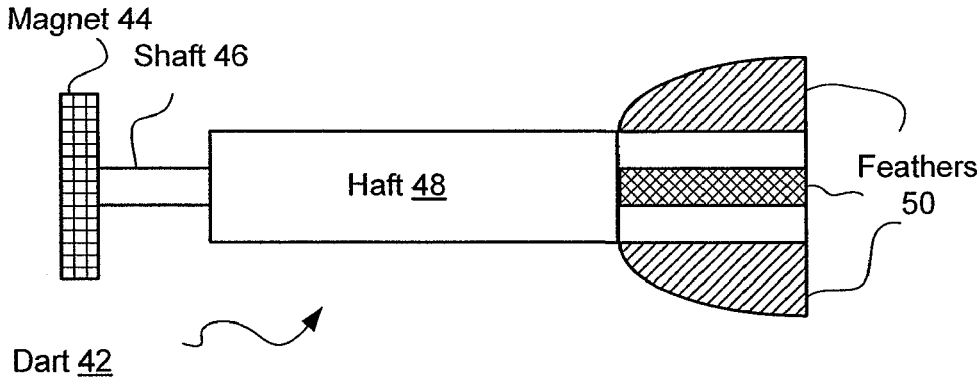
FIG. 3 is a side view of magnetic dart 42 suitable for use with dart board 10.

Referring now to FIG. 3, dart 42 may conveniently include magnet 44, such as an N64 rare earth magnet, sufficiently magnetic to cause dart 42 to stick to the central portions of frame 14, (shown in FIG. 1) through target skin 28. Frame 14, or at least central portions thereof, may conveniently be made of a ferrous or other magnetic material so that dart 42 will be held to the portion of target 32 it strikes when properly thrown by the game player. Dart 42 may also conveniently include shaft 46 connecting magnet 44 to haft 48 which is conveniently sized for holding by a dart player. Dart 42 may conveniently be sized according to appropriate dart board rules or custom.

Figure 4:
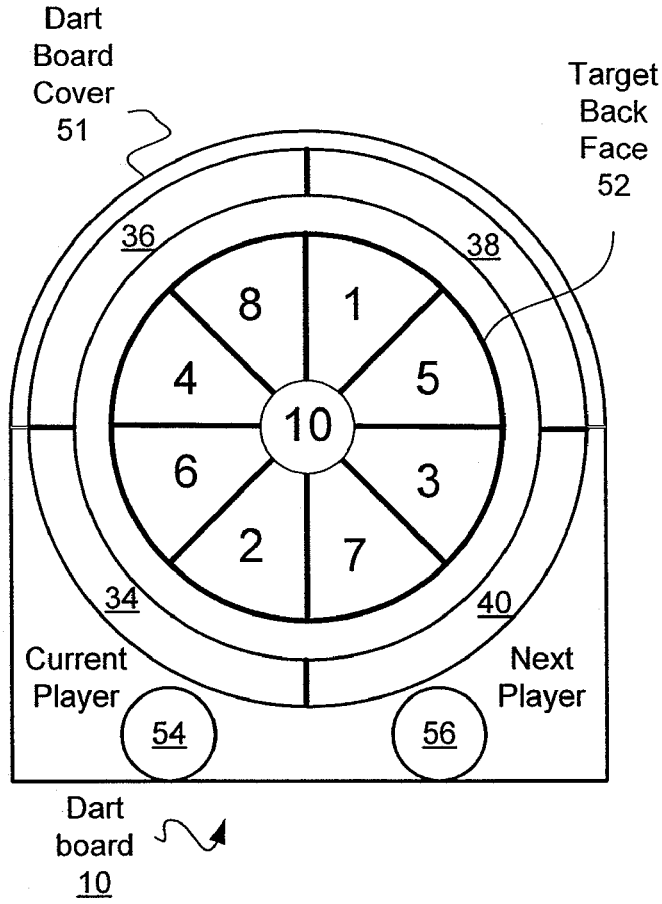
FIG. 4 is a front view of an alternate dart board cover 51 on which are mounted dart actuated game play controls.

Referring now to FIG. 4, dart board 10 with cover 51 is shown in an alternate embodiment with target reverse or back face 52 of rotatable target skin 28 visible in a central opening in cover 51. Target skin 28 may conveniently be printed with different target designs on a front and reverse or back face so that after cover 51 is removed, target skin 28 may be removed from frame 14 (shown for example in FIG. 1) and then reinserted in frame 14 so that a different face is visible. Similarly, target skin 28 may be removed without removal of cover 51 and/or replaced with a different target, which may also have a front and back face so that the target, and therefore the game play, for dart board 10 may be changed by simply removing and flipping a first target or replacing the target with another target.

Controls 22 (shown for example in FIG. 2) are shown in this figure in the form of a ring surrounding target face 52. Preferably, one or more control buttons 34, 36, 38 and 49 may be mounted in this embodiment on cover 30 with a ferrous or magnetic surface to which dart 42 will become attached when thrown (such as button target 78 shown below in FIG. 6). Further, the attachment of dart 42 on a particular button may be detected, for example, by electronic circuitry in button 55 (also shown below in FIG. 6), so that the game player may change the operation of the board and/or game play by hitting the button with a dart. Dart board 10 may be configured so that operation of controls 22 by hitting a selected button with a dart may change the current operation of the game play or for the subsequent player. For example, a first player may hit button 36 to cause rotation of target 52 to be at the slower speed, or depending upon game play, the first player may hit button 36 to cause the target to rotate at a faster speed to make game play for a second player more difficult.

Similarly, the selection of the game play, that is, whether operation of controls 22 by a properly thrown dart 42 affects current play, or the next player, may be controlled by operation of buttons 54 and 56 respectively which preferably may be operated by dart 42. Buttons to be operated by dart 42, may be pressure or magnetically actuated switches which detect dart 42 mounted in the portion of dart board cover 51 at any location suitable for game play except, of course, the switches may not be positioned in the central opening of cover 51 through which the face of target 52 is visible and may be rotating.

Figure 5:
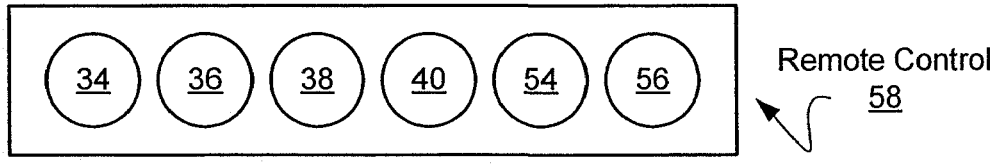
FIG. 5 is a top view of a remote control for use with dart board 10.

Referring now to FIG. 5, in addition to or as an alternate to controls 22 positioned on dart board 10, remote control 58 may be used to actuate some or all of buttons 34, 36, 38, 40, 54, 56 or other game play controls 22 as well as buttons to turn game board 10 on or off. Electronic circuitry in remote control 58 may interact with electronic circuitry in controls 22 to operate motor 16.

Figure 6:
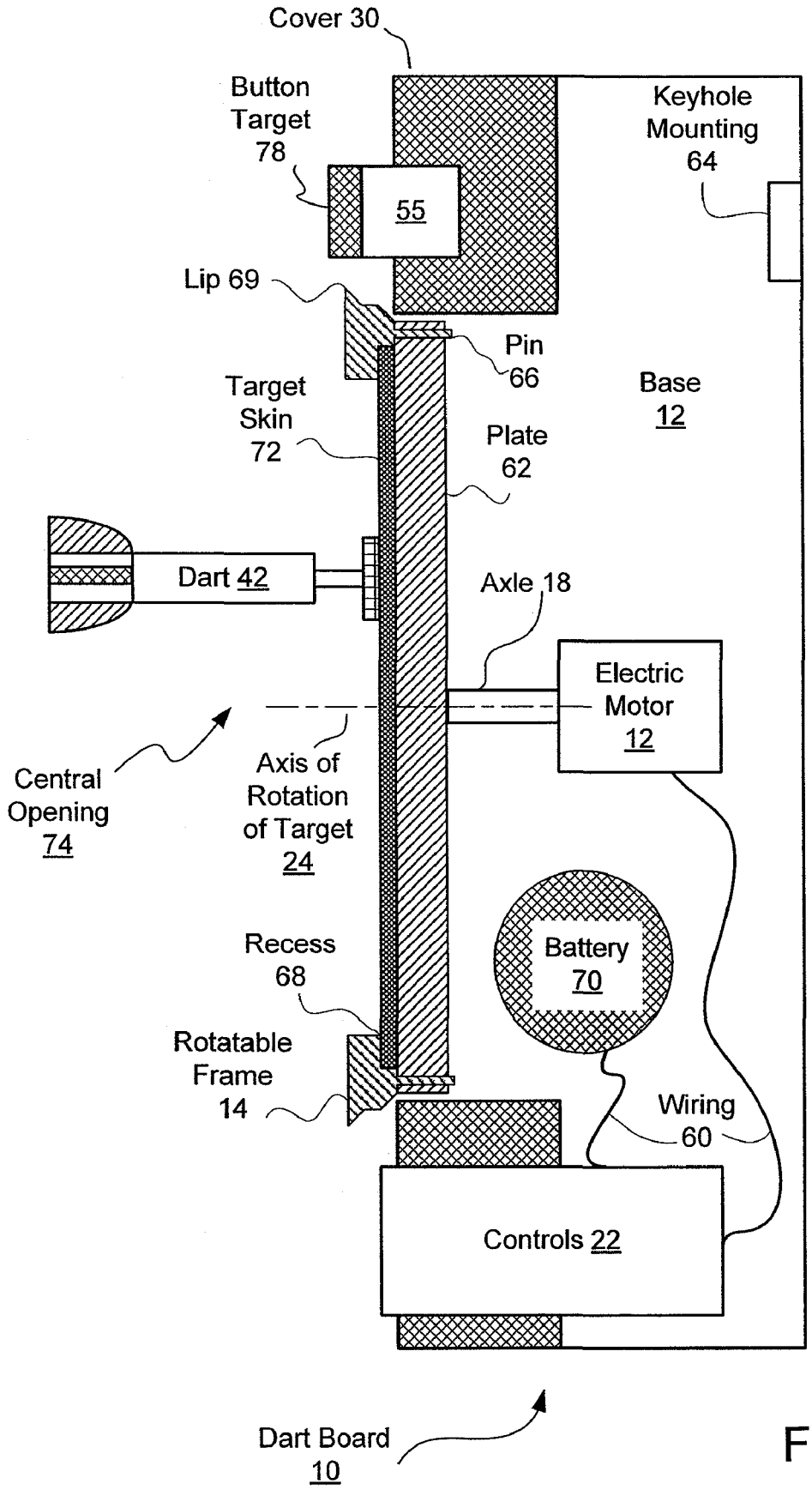
FIG. 6 is a partially cutaway side view of dart board 10.

Referring now to FIG. 6, a cross sectional view of dart board 10 in a further embodiment is shown in which dart 42 is shown after it has been thrown and appears to be attached to rotatable, reversible and replaceable target skin 72, a portion of the back face of which (shown as target back face 52 in FIG. 4) is visible to the dart thrower in central opening 74 of cover 30. Target skin 72 provides one or more target faces and rotates about axis 24 with rotatable frame 14. Dart board 10 is re-skinnable in that the target visible to the dart thrower is easily changed by the dart thrower, a manufacturer or a distributor by reversing or replacing target skin 72.

In particular, rotatable frame 14 may be affixed by pins 66 to ferromagnetic plate 62 which is mounted for rotation about axis 24 by axle 18 of electric motor 12. Frame 14 may include internal recess 68 to removable hold target skin 72 against plate 62 and external lip 69 to aid in the removal of the frame, and therefore the target skin, from plate 62 by pulling out pins 66. The outer edge of frame 14 may also extend past the inner edge of cover 30 so that no gap between frame 14 and cover 30 is visible. Magnet 44 of dart 42 holds the dart against target skin 72 by magnetic attraction to plate 62.

Controls 22 may be mounted to dart board 10 and extend through cover 30 for manual operation. Targetable button 55, which may be operated by dart 42, may be mounted in cover 30 and magnetic button target 55 may be struck and operated by dart 42. Button 55 may be used for example to toggle, or switch between, particular operating states controlled by controls 22. For example, if the rotational speed is set to fast, operation of button 55 may change the speed to slow and vice versa. Similarly, toggle button 55 may be used to reverse the direction of rotation of target skin 72 and/or cause the rotation of target skin 72 to become random or cease being random.

All functions of dart board 10 may also be controlled by remote control 58 (shown in FIG. 5) to control the operation of motor 12 which may be powered in any convenient manner including by battery 70 under the control of electronic controls 22. Controls 22 may be wired to battery 70 and electric motor 16. Dart board 10 may be mounted to a wall or other surface by keyhole mounting 64.

The invention claimed is:

1. A dart board game, comprising:

a target skin having a pattern thereon forming a game play target for magnetic darts;

a rotatable target support for supporting the target skin for rotation during game play, the support interacting with the magnetic darts to hold the magnetic darts to the target skin when properly thrown;

an electric motor for rotating the target skin and the rotatable target support during game play; and player operated controls for changing rotational speed and direction of the target support, wherein the controls are mounted along a periphery of the target skin and operated in response to magnetic darts when properly thrown.

2. The game of claim 1 wherein the player operated controls further comprise: a button for causing the rotational speed and direction of the target support to change randomly.

3. The game of claim 1 wherein the player operated controls further comprise: a button for causing the rotation speed and direction of the target support to change for a subsequent game player.

4. The game of claim 1 wherein the target skin is replaceable by a game player.

5. The game of claim 1 wherein the target skin is reversible by a game player to display a different game play target.

6. A game apparatus comprising:

a plurality of darts;

a frame;

a primary target on a surface of the frame;

an electric motor connected to the primary target;

the electric motor rotating the target relative to the frame;

a secondary target on a surface of the frame adjacent to the primary target;

the secondary target signaling the electric motor to affect rotation of the primary target when contacted by one of the darts; and the secondary target further comprising a magnetic sensor.

7. The game apparatus of claim 6 wherein the secondary target signals the electric motor to alter the angular velocity of the primary target relative to the frame.

8. The game apparatus of claim 6 wherein the secondary target signals the electric motor to continuously and randomly alter the angular velocity of the primary target relative to the frame.

9. A game apparatus comprising:

a plurality of darts;

a frame;

a primary target on a surface of the frame;

an electric motor connected to the primary target;

the electric motor rotating the target relative to the frame;

a secondary target on a surface of the frame adjacent to the primary target;

the secondary target signaling the electric motor to affect rotation of the primary target when contacted by one of the darts; and the secondary target signaling the electric motor to continuously and randomly alter the angular velocity of the primary target relative to the frame.

10. The game apparatus of claim 9 wherein the secondary target further comprises an impact pressure sensor.

11. The game apparatus of claim 9 wherein the secondary target includes a magnetic sensor.

* * * * *